US011441271B2

(12) United States Patent
Pande et al.

(10) Patent No.: US 11,441,271 B2
(45) Date of Patent: Sep. 13, 2022

(54) PAPER PRODUCTS AND PULPS WITH SURFACE ENHANCED PULP FIBERS AND INCREASED ABSORBENCY, AND METHODS OF MAKING SAME

(71) Applicants: Harshad Pande, Montreal (CA); Douglas W. Coffin, Oxford, OH (US); Mona Alinejad, Oxford, OH (US)

(72) Inventors: Harshad Pande, Montreal (CA); Douglas W. Coffin, Oxford, OH (US); Mona Alinejad, Oxford, OH (US)

(73) Assignees: Domtar Paper Company LLC, Fort Mill, SC (US); Miami University, Oxford, OH (US)

( * ) Notice: Subject to any disclaimer, the term of this patent is extended or adjusted under 35 U.S.C. 154(b) by 0 days.

(21) Appl. No.: 16/267,755

(22) Filed: Feb. 5, 2019

(65) Prior Publication Data

US 2019/0242062 A1 Aug. 8, 2019

Related U.S. Application Data

(60) Provisional application No. 62/626,261, filed on Feb. 5, 2018.

(51) Int. Cl.
*D21H 11/10* (2006.01)
*D21H 27/00* (2006.01)
(Continued)

(52) U.S. Cl.
CPC ..... *D21H 11/10* (2013.01); *D21D 1/00* (2013.01); *D21H 15/02* (2013.01);
(Continued)

(58) Field of Classification Search
CPC ..... D21H 15/02; D21H 11/16; D21H 11/10; D21H 17/72; D21H 25/005; D21H 11/20;
(Continued)

(56) References Cited

U.S. PATENT DOCUMENTS 3,098,785 A 7/1963 Meiler
3,388,037 A 6/1968 Asplund et al.
(Continued)

FOREIGN PATENT DOCUMENTS

AU 2013305802 8/2012
AU 2015218812 8/2015
(Continued)

OTHER PUBLICATIONS

Carvalho, et al., "A Comparative Study for Two Automated Techniques for Measuring Fiber Length," *Tappi Journal, Technical Association of The Pulp & Paper Industry*, 80(2): 137-142, 1997.
(Continued)

*Primary Examiner* — Jose A Fortuna
(74) *Attorney, Agent, or Firm* — Troutman Pepper Hamilton Sanders LLP

(57) ABSTRACT

Paper products such as tissues can be made using a furnish comprising surface enhanced pulp fibers ("SEPF"). In some embodiments, SEPF have a weighted average fiber length of at least 0.3 millimeters (mm) and an average hydrodynamic specific surface area of at least 10 square meters per gram ($m^2/g$). In some embodiments, a furnish or a paper product can comprise at least 2 % SEPF by dry weight. In some embodiments, a paper product comprising SEPF can be formed from a furnish having a freeness of 650 ml Canadian Standard Freeness (CSF) or less, optionally 600 ml CSF or less.

8 Claims, 7 Drawing Sheets

(51) Int. Cl.
*D21H 25/00* (2006.01)
*D21H 15/02* (2006.01)
*D21D 1/00* (2006.01)

(52) U.S. Cl.
CPC ..... *D21H 25/005* (2013.01); *D21H 27/002* (2013.01); *D21H 27/007* (2013.01)

(58) Field of Classification Search
CPC .... D21H 27/002; D21H 27/007; D21C 9/007; D21C 9/00; D21D 1/00; D21D 1/20
See application file for complete search history.

(56) References Cited

U.S. PATENT DOCUMENTS 3,708,130 A 1/1973 Perry
3,794,558 A 2/1974 Back
3,873,412 A * 3/1975 Charters ..... D21B 1/12 162/25
3,891,499 A * 6/1975 Kato ..... D21H 5/202 162/157.5
3,920,508 A 11/1975 Yonemori
3,966,543 A 6/1976 Cayle et al.
4,012,279 A 3/1977 Selander et al.
4,054,625 A * 10/1977 Kozlowski ..... D01D 5/11 264/13
4,247,362 A 1/1981 Williams
4,635,864 A 1/1987 Peterson et al.
4,895,019 A 1/1990 Lehmikangas et al.
4,925,530 A * 5/1990 Sinclair ..... D21H 23/14 162/164.1
5,110,412 A 5/1992 Fuentes et al.
5,248,099 A 9/1993 Lahner et al.
5,308,449 A 5/1994 Fuentes et al.
5,695,136 A 12/1997 Rohden et al.
5,731,080 A 3/1998 Cousin et al.
5,824,364 A 10/1998 Cousin et al.
5,954,283 A 9/1999 Matthew
6,156,118 A 12/2000 Silenius
6,165,317 A 12/2000 Sabourin
6,251,222 B1 6/2001 Silenius et al.
6,296,736 B1 10/2001 Hsu et al.
6,348,127 B1 * 2/2002 Gallagher ..... D21C 1/10 162/18
6,375,974 B1 4/2002 Ito et al.
6,599,391 B2 7/2003 Silenius et al.
6,773,552 B1 8/2004 Albert et al.
6,861,380 B2 3/2005 Garnier et al.
6,887,350 B2 5/2005 Garnier et al.
6,935,589 B1 8/2005 Matthew
6,946,058 B2 * 9/2005 Hu ..... B31F 1/12 162/111
6,955,309 B2 10/2005 Matthew et al.
7,381,294 B2 6/2008 Suzuki et al.
7,624,879 B2 12/2009 Frances
7,741,234 B2 6/2010 Smith et al.
7,942,964 B2 5/2011 Luo et al.
8,871,057 B2 10/2014 Gane et al.
9,297,112 B2 * 3/2016 Mesic ..... D21D 1/20
9,879,361 B2 * 1/2018 Pande ..... D21H 11/10
9,920,484 B2 * 3/2018 Marcoccia ..... D21H 17/25
9,988,762 B2 * 6/2018 Bilodeau ..... D21D 1/30
10,563,356 B2 * 2/2020 Marcoccia ..... D21H 17/72
10,704,165 B2 * 7/2020 Pande ..... D02J 3/02
10,710,930 B2 * 7/2020 Marcoccia ..... C04B 18/241
2002/0011317 A1 * 1/2002 Lee ..... D21C 9/163 162/9
2002/0059886 A1 5/2002 Merkley et al.
2002/0069791 A1 6/2002 Merkley et al.
2002/0084046 A1 7/2002 Hsu et al.
2003/0111197 A1 * 6/2003 Hu ..... B31F 1/12 162/129
2004/0112558 A1 6/2004 Garnier et al.
2004/0112997 A1 6/2004 Matthew et al.
2004/0180184 A1 9/2004 Fillion et al.
2004/0241350 A1 12/2004 Koga et al.
2005/0145348 A1 * 7/2005 Lee ..... D21C 9/007 162/4
2005/0194477 A1 9/2005 Suzuki
2006/0006264 A1 1/2006 Sabourin et al.
2007/0164143 A1 7/2007 Sabourin et al.
2008/0148999 A1 6/2008 Luo et al.
2008/0227161 A1 9/2008 Levie et al.
2009/0145562 A1 6/2009 Nguyen
2009/0145842 A1 6/2009 Frances
2009/0162602 A1 6/2009 Cottier et al.
2009/0221812 A1 9/2009 Ankerfors et al.
2009/0266500 A1 * 10/2009 Schubert ..... D21H 11/06 162/29
2010/0065236 A1 3/2010 Henriksson et al.
2010/0218908 A1 9/2010 Silenius et al.
2010/0288456 A1 11/2010 Westland et al.
2011/0277947 A1 11/2011 Hua et al.
2011/0314726 A1 12/2011 Jameel et al.
2012/0007363 A1 1/2012 Wang
2012/0012031 A1 1/2012 Husband et al.
2013/0202870 A1 8/2013 Malmborg et al.
2013/0209749 A1 * 8/2013 Myangiro ..... D21F 7/086 428/174
2014/0057105 A1 * 2/2014 Pande ..... D21H 11/16 428/401
2014/0116635 A1 5/2014 Porto et al.
2014/0180184 A1 6/2014 Duguid
2014/0209260 A1 7/2014 Li et al.
2014/0209264 A1 * 7/2014 Tirimacco ..... D21H 17/52 162/164.3
2014/0302117 A1 * 10/2014 Moen ..... A47K 10/16 424/443
2015/0299955 A1 10/2015 Laukkanen et al.
2016/0333524 A1 * 11/2016 Pande ..... D21H 11/16
2016/0340802 A1 * 11/2016 Pande ..... D02J 3/02
2017/0058457 A1 * 3/2017 Marcoccia ..... D21H 19/54
2017/0073893 A1 * 3/2017 Bilodeau ..... D21D 1/306
2017/0226009 A1 * 8/2017 Marcoccia ..... C04B 28/02
2018/0105986 A1 * 4/2018 Pande ..... D21H 25/005
2018/0148895 A1 * 5/2018 Marcoccia ..... D21H 19/54
2019/0218716 A1 * 7/2019 Hoglund ..... D21H 11/10
2019/0242062 A1 * 8/2019 Harshad ..... D21H 11/10
2020/0063353 A1 * 2/2020 Everett ..... D21H 15/04
2020/0308769 A1 * 10/2020 Pande ..... D21H 15/04
2020/0325629 A1 * 10/2020 Marcoccia ..... D21H 15/02
2020/0340155 A1 * 10/2020 Pande ..... A41D 13/1209

FOREIGN PATENT DOCUMENTS

CA 2883161 2/2014
CN 1516768 7/2004
CN 1718914 1/2006
CN 101691700 4/2010
CN 102971462 3/2013
CN 103590283 2/2014
EP 0333209 9/1989
EP 0333212 9/1989
EP 2220291 5/2017
FR 2520769 A1 * 8/1983 ..... D21D 1/306
JP S58-136895 8/1983
JP H02229747 9/1990
JP H03122038 5/1991
JP H04194097 7/1992
JP H 04263699 9/1992
JP H07165456 6/1995
JP H08197836 8/1996
JP H08284090 10/1996
JP H09-124950 5/1997
JP 2002194691 7/2002
JP 2004525284 8/2004
JP 2004360088 12/2004
JP 2007231438 9/2007
JP 2010125694 6/2010
JP 2012526923 11/2012
JP 2015526608 9/2015
JP 2018135631 A * 8/2018 ..... D21D 1/06
KR 2004/0022874 3/2004

(56) References Cited

FOREIGN PATENT DOCUMENTS

| | | | | |
|---|---|---|---|---|
| KR | 1020050086850 | | 8/2005 | |
| KR | 10-0662043 | B | 12/2006 | |
| KR | 10-2010-0090745 | | 8/2010 | |
| KR | 1020130132381 | | 12/2013 | |
| RU | 2224060 | | 2/2004 | |
| RU | 2309211 | | 10/2007 | |
| RU | 2358055 | | 6/2009 | |
| WO | WO 96/04424 | | 2/1996 | |
| WO | WO 98/23814 | | 6/1998 | |
| WO | WO 2002/014606 | | 2/2002 | |
| WO | WO 2002/095129 | | 11/2002 | |
| WO | WO 2004/101889 | | 11/2004 | |
| WO | WO 2009/038730 | | 3/2009 | |
| WO | WO 2009/155541 | | 12/2009 | |
| WO | WO 2010/134868 | | 11/2010 | |
| WO | WO 2012/007363 | | 1/2012 | |
| WO | WO 2012/101331 | | 8/2012 | |
| WO | WO 2014/031737 | | 2/2014 | |
| WO | WO-2014031737 | A1 * | 2/2014 | ..... D01B 9/00 |
| WO | WO 2014/106684 | | 7/2014 | |
| WO | WO 2015/127233 | | 8/2015 | |
| WO | WO 2015/127239 | | 8/2015 | |
| WO | WO 2018/026804 | | 2/2018 | |
| WO | WO 2018/051275 | | 3/2018 | |
| WO | WO-2019152969 | A1 * | 8/2019 | ..... D21H 27/002 |

OTHER PUBLICATIONS

International Search Report and Written Opinion Issued in Corresponding PCT Patent Application No. PCT/US2020/025037, dated Jul. 16, 2020.

International Search Report and Written Opinion Issued in Corresponding PCT Patent Application No. PCT/US2020/028986, dated Jul. 17, 2020.

Brazilian Search Report Issued in Corresponding Brazilian Patent Application No. BR112015003819-0, dated Sep. 9, 2019.

Extended European Search report issued in European Patent Application No. 17195921.6, dated Nov. 20, 2017.

International Preliminary Report on Patentability issued in International Patent Application No. PCT/US2013/055971, dated Feb. 24, 2015.

International Preliminary Report on Patentability issued in International Patent Application No. PCT/US2015/016858, dated Aug. 23, 2016.

International Preliminary Report On Patentability issued in International Patent Application No. PCT/US2015/016865, dated Aug. 23, 2016.

International Search Report and Written Opinion issued in International Patent Application No. PCT/US2013/055971, dated Oct. 24, 2013.

International Search Report and Written Opinion issued in International Patent Application No. PCT/US2015/016858, dated May 15, 2015.

International Search Report and Written Opinion issued in International Patent Application No. PCT/US2015/016865, dated May 20, 2015.

International Search Report and Written Opinion issued in International Patent Application No. PCT/US2017/057161, dated Dec. 22, 2017.

International Search Report and Written Opinion issued in International Patent Application No. PCT/US2017/044881, dated Oct. 18, 2017.

Office Action Issued in Corresponding Korean Patent Application No. 10-2015-7006955, dated May 29, 2020.

Pala et al., "Refining and enzymatic treatment of secondary fibres for paperboard production: Cyberflex measurements of fibre flexibility" COST E20—Wood Fibre Cell Wall Structure 2001, 4 pages.

Declaration of Harshad Pande and Bruno Marcoccia, filed in U.S. Appl. No. 13/836,760, dated Oct. 12, 2016.

Handbook of Pulping and Papermaking, C. Biermann, Academic Press; 2nd Edition (Aug. 5, 1996), p. 145.

International Search Report and Written Opinion issued in Corresponding International Patent Application No. PCT/US2019/016590, dated May 23, 2019.

La Vrykova-Marrain et al., "Characterizing the drainage resistance of pulp and microfibrillar suspensions using hydrodynamic flow measurements," TAPPI's PaperCon 2012 Conference.

Pal et al., "A Simple Method for Calculation of the Permeability Coefficient of Porous Media," TAPPI Journal, 5(9):10-16, (2006).

Teixeira, "Recycled Old Corrugated Container Fibers for Wood-Fiber Cement Sheets," International Scholarly Research Network 2012(923413): 1-8, 2012.

Tonoli et al., "Effect of Fibre morphology on flocculation of fibre-cement suspensions," Cement and Concrete Research, 39:1017-1022, (2009).

Demuner et al., "Ultra low intensity refining of eucalyptus pulps." Scientific and technical advances in refining and mechanical pulping 2005.

Joy et al., "Ultra-Low intensity refining of short fibered pulps." African Pulp and Paper Week 2004 retrieved from URL:<https://www.tappsa.eo.za/archive2/APPW_2004/Title2004/Ultra-low_intensity_refining/ultra-low_intensity_refining.html >.

Office Action issued in corresponding European Patent No. 17195921 dated Apr. 17, 2019.

Office Action Issued in Corresponding Chinese Patent Application No. 201810081469.0, dated Jan. 21, 2020.

Office Communication issued in U.S. Appl. No. 15/787,147, dated Nov. 23, 2020.

* cited by examiner

PAPER PRODUCTS AND PULPS WITH SURFACE ENHANCED PULP FIBERS AND INCREASED ABSORBENCY, AND METHODS OF MAKING SAME

CROSS-REFERENCE TO RELATED APPLICATIONS

This application claims priority to and the benefit of U.S. Provisional Application No. 62/626,261, filed Feb. 5, 2018. The contents of the referenced patent applications are incorporated into the present application by reference.

FIELD OF INVENTION

The present invention relates generally to paper products and pulp, and more specifically, but not by way of limitation, to absorbent paper products having improved absorbency over conventional paper products, and methods of making the same. Such absorbent paper products can include tissue, fluff, or non wovens.

BACKGROUND

Paper products, including papers, paperboard, tissues, fluff, biofiber composites, absorbent products, non wovens, or the like, can have properties determined at least in part by the pulp fibers from which the product is made. Pulp fibers can be obtained from a variety of wood types, including hardwoods, softwoods, and non-woods. To form a product that has desired properties, pulp fibers can be refined before they are incorporated into the product to, for example, increase fibrillation. Conventionally refined fibers are usually passed through a refiner, and generally no more than two to three times; the refiner is typically operated at relatively low energy.

Pulp fibers typically have a length weighted average fiber length ranging between 0.5 and 3.0 millimeters prior to refining. However, conventional refining can cause significant reductions in fiber length, can generate an undesirable amount of fines, and can otherwise impact the fibers in a manner that can adversely affect the end product, an intermediate product, and/or the manufacturing process. For example, refining can cause a reduction in the size of pores of a product, thereby decreasing absorbency, and a shortening of fibers, which can decrease strength.

SUMMARY

Accordingly, there is a need in the art for pulp fiber furnish to produce paper-grade products that have improved properties, such as absorbency, and tissues that have such improved properties. Providing pulps that comprise surface enhanced pulp fibers ("SEPF") addresses the above-noted limitations of conventional pulps. This disclosure includes embodiments of pulps comprising SEPF, paper products made from such pulps, and methods of making pulps and paper products having SEPF. The present pulps can be used to form paper products having (1) increased absorbency over paper products formed from conventional pulps—e.g., pulps that omit SEPF—that have a similar freeness, or (2) similar absorbency as paper products formed from conventional pulps that have a higher freeness. The present paper products can include tissues that have increased absorbency while being as strong as or stronger than comparable tissues omitting SEPF. When compared to a conventional tissue having substantially the same tear index, a tissue having SEPF can be more absorbent; for example, a tissue with SEPF can have at least a 25% improvement in water pick-up capabilities over a conventional tissue.

Some embodiments of the present paper products comprise a tissue that includes a plurality of surface enhanced pulp fibers and a plurality of softwood fibers. In some embodiments, the softwood fibers comprise Northern bleached softwood kraft fibers. In some embodiments the tissue comprises at least 2% surface enhanced pulp fibers by weight. In other embodiments, the tissue can comprise between 5% and 25% surface enhanced pulp fibers by weight. In some embodiments, the surface enhanced pulp fibers have the surface enhanced pulp fibers have a length weighted average fiber length of at least 0.3 millimeters (mm) and an average hydrodynamic specific surface area of at least 10 square meters per gram ($m^2/g$). In some embodiments, the surface enhanced pulp fibers originated from softwood fibers.

In some embodiments of the present tissues, the tissue is formed from a furnish having a freeness of 650 milliliters Canadian Standard Freeness (ml CSF) or less. In other embodiments, the tissue is formed from a furnish having a freeness of 600 ml CSF or less. In other embodiments, the tissue is formed from a furnish having a freeness between 550 ml CSF and 600 ml CSF.

In some embodiments of the present tissues, the absorbent index of the tissue is at least 25%. In some embodiments, the tissue has a grammage between 20 grams per square meter ($g/m^2$) and 45 $g/m^2$.

In some embodiments of the present methods of manufacturing a tissue, the method comprises mixing at least a first pulp and a second pulp to generate a furnish. In some embodiments, the first pulp comprises surface enhanced pulp fibers having a length weighted average fiber length of at least 0.3 mm and an average hydrodynamic specific surface area of at least 10 $m^2/g$. In some embodiments, the second pulp comprises softwood fibers. In some embodiments, the softwood fibers comprise Northern bleached softwood kraft fibers. In some embodiments, the surface enhanced pulp fibers originated from softwood fibers. In some embodiments, mixing is performed such that the furnish comprises at least 3% surface enhanced pulp fibers by dry weight of fiber in the furnish. In other embodiments, mixing is performed such that the furnish comprises between 5% and 25% surface enhanced pulp fibers by dry weight of fiber in the furnish.

Some embodiments of the present methods of manufacturing a tissue comprise a step of beating, with a refiner, at least one of (a) the second pulp prior to mixing the first and second pulps and (b) the furnish. In some embodiments, beating is performed such that the furnish has a freeness less than or equal to 650 ml CSF. In other embodiments, beating is performed such that the furnish has a freeness of 600 ml CSF or less. In other embodiments, beating is performed such that the furnish has a freeness between 550 ml CSF and 600 ml CSF.

Some embodiments of the present methods of manufacturing a tissue comprise a step of forming one or more sheets of tissue using the furnish. In some embodiments, forming is performed such that the sheet(s) have a grammage between 20 and 45 $g/m^2$.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The terms "substantially," "about," and "approximately" are defined as largely but not necessarily wholly what is specified—and includes what is specified; e.g., substantially 90 degrees includes 90 degrees and substantially parallel includes parallel—as understood by a person of ordinary skill in the art. In any disclosed embodiment, the terms "substantially," "about," and "approximately" may be substituted with "within [a percentage] of" what is specified, where the percentage includes 0.1, 1, 5, and 10 percent.

The terms "comprise" and any form thereof such as "comprises" and "comprising," "have" and any form thereof such as "has" and "having," and "include" and any form thereof such as "includes" and "including" are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Further, a device or system that is configured in a certain way is configured in at least that way, but it can also be configured in other ways than those specifically described.

The feature or features of one embodiment may be applied to other embodiments, even though not described or illustrated, unless expressly prohibited by this disclosure or the nature of the embodiments. Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. Views in the figures are drawn to scale, unless otherwise noted, meaning the sizes of the depicted elements are accurate relative to each other for at least the embodiment in the view.

DETAILED DESCRIPTION OF ILLUSTRATIVE EMBODIMENTS

Figure 1:
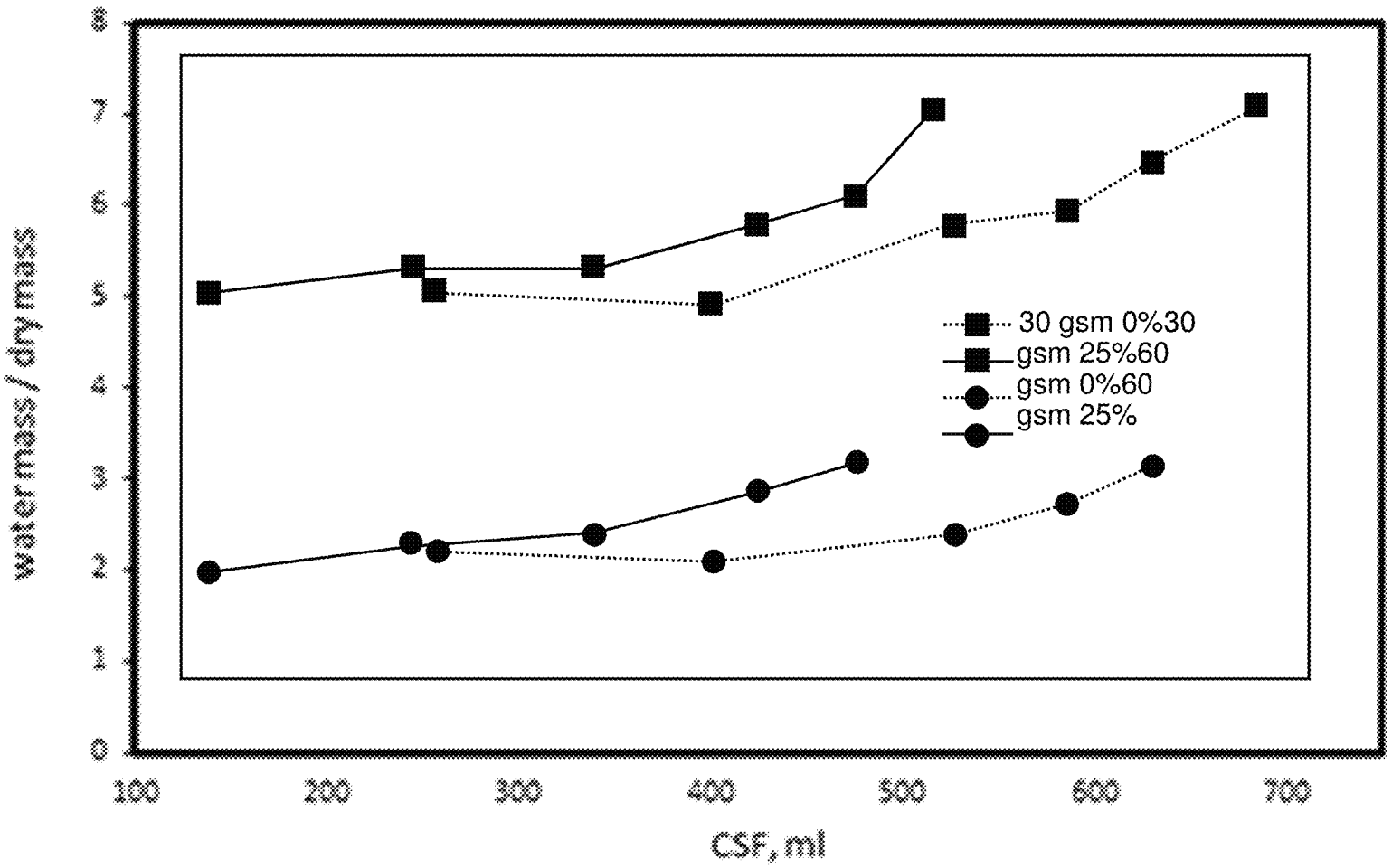
FIG. 1 is a graph illustrating the relationship between water absorption ratio and freeness for some of the present paper products.

Some embodiments of the present methods comprise a step of generating a furnish that can, for the same level of refining, have a lower freeness than a conventional furnish; likewise, the furnish can be refined to reach a given freeness using less refining energy than that required for a conventional furnish. As will be described in further detail below, at a given level of freeness, the furnish can be used to form a paper product, such as a tissue or fluff, that has improved absorbency when compared to paper products made with conventional furnishes.

In some methods, generating the furnish can comprise mixing a first stream of pulp fibers with a second stream of surface enhanced pulp fibers, hereinafter "SEPF." A description of SEPF and methods by which SEPF can be made is set forth in U.S. patent application Ser. No. 13/836,760, filed Mar. 15, 2013, and published as Pub. No. US 2014/0057105 on Feb. 27, 2014, which is hereby incorporated by reference. Any SEPF described in the above-referenced application can be used in the present methods; for example, SEPF can comprise pulp fibers refined using between 400 and 600 kilowatt-hours per ton (kWh per ton) of pulp on a dry basis, for example 450, 500, or 550 kWh per ton. In some methods, the fibers of the first stream can comprise both softwood fibers and hardwood fibers, or, optionally, can comprise solely softwood fibers. For example, the first stream can comprise greater than or substantially equal to, or between any two of: 10%, 20%, 30%, 40%, 50%, 60%, 70%, 80%, or 90% softwood fibers by dry weight. SEPF can, in some methods, comprise fibers originating from hardwood sources; nevertheless, in other methods, SEPF can comprise fibers originating from softwood sources. Suitable softwood pulp fiber can comprise, for example, fibers originating from spruce, pine, fir hemlock, southern pine, redwood, and/or the like. Suitable hardwood fibers can comprise, for example, fibers originating from oak, gum, maple, poplar, *eucalyptus*, aspen, birch and/or the like.

At least some of the fibers of the first stream can preferably be bleached or partially bleached and the SEPF can be bleached, partially bleached, or unbleached; however, in other methods, at least some of the fibers of the first stream are not bleached. In some methods, the fibers of the first stream and the SEPF can originate from any suitable source, such as, for example: (1) a chemical source, such as, for example, a Kraft process, a sulfite process, a soda pulping process, or the like; (2) a mechanical source, such as, for example, a thermomechanical process (TMP), a bleached chemi-thermomechanical process; or (3) a combination thereof. In some methods, the fibers of the first stream are preferably obtained from a Kraft process. For example, the fibers of the first stream can comprise Northern softwood kraft pulp fibers. In other methods, the SEPF and/or the fibers of the first stream can comprise any pulp fibers suitable for use in forming a particular paper product such as, for example, hardwood pulp fibers, non-wood pulp fibers, or a combination of softwood, hardwood, and/or non-wood pulp fibers. Non-wood fibers can comprise fibers from a source such as linen, cotton, bagasse, hemp, straw, kenaf, and/or the like.

In some methods, the pulp fibers of the first stream are not refined prior to mixing; however, in other methods, the pulp fibers of the first stream can be refined using, for example, a mechanical refiner. A refiner can comprise, for example, a double disk refiner, a conical refiner, a single disk refiner, a multi-disk refiner, a combination of conical and disk refiners, or the like. Pulp fibers in the first stream and/or the SEPF can be in a pulp slurry or in a baled condition. By way of example, a pulp slurry can comprise approximately 95% or more liquid and about 5% or less solids; in other methods, a pulp slurry can comprise approximately 70%, 75%, 80%, 85%, or 90%, 95%, or 97% liquid and 30%, 25%, 20%, 15%, 10%, 5% or 3% solids, respectively. Pulp fibers in a baled condition can comprise less than 50% liquid and more than 50% solids. By way of illustration, fibers in a baled condition can comprise between approximately 7% and 11% liquid and between approximately 89% and 93% solids. In some methods, the pulp fibers have not been dried on a pulp dryer.

The characteristics of SEPF can affect the properties of a furnish comprising the SEPF and/or the properties of a paper product formed from the furnish. SEPF can have a length weighted average fiber length of at least 0.20 mm, 0.25 mm, 0.30 mm, 0.35 mm, 0.40 mm, 0.45 mm, or 0.50 mm. As used herein, length weighted average length Lw is calculated according to the formula:

$$L_W = \frac{\sum n_i l_i^2}{\sum n_i l_i}$$

where $n_i$ refers to the number of fibers in the ith class, and $I_i$ refers to the mean fiber length of the ith class. Length weighted average length can be measured using any suitable device, such as, for example, a LDA02 Fiber Quality Analyzer or a LDA96 Fiber Quality Analyzer, each of which are from OpTest Equipment, Inc. of Hawkesbury, Ontario, Canada, and in accordance with the appropriate procedures specified in the manual accompanying the Fiber Quality Analyzer.

In some embodiments, SEPF can have a large hydrodynamic specific surface area relative to conventionally refined fibers. By way of example, in some methods the generated SEPF can have an average hydrodynamic specific area of at least 10 square meters per gram ($m^2/g$), optionally at least 12 $m^2/g$. By contrast, conventionally refined fibers can have a hydrodynamic specific surface area of 2 $m^2/g$. Hydrodynamic specific surface area can be measured using any suitable procedure, such as, for example, the procedure specified in *Characterizing the drainage resistance of pulp and microfibrillar suspensions using hydrodynamic flow measurements,* N. Lavrykova-Marrain and B. Ramarao, PaperCon 2012 Conference, available at http://tappi.org/Hide/Events/12PaperCon/Papers/12PAP116.aspx, which is hereby incorporated by reference. In some embodiments, the number of SEPF is at least 12,000 per milligram on an oven-dry basis. As used herein, "oven-dry basis" means that the sample is dried in an oven set at 105° C. for 24 hours.

In some methods, the SEPF can have a length weighted fines value of less than 20%, 25%, 30%, 35%, or 40%, for example approximately 20% or 22%. The percentage of length weighted fines is calculated according to the formula:

$$\%\text{ of length weighted fines} = \frac{100 \times \sum n_i l_i}{L_T}$$

where $n_i$ refers to the number of fibers having a length of less than 0.2 mm in the ith class, $I_i$ refers to the mean fiber length of the fines in the ith class, and $L_T$ refers to the total fiber length of all fibers in the sample. Length weighted fines value can be measured using any suitable device, such as, for example, a LDA02 Fiber Quality or a LDA96 Fiber Quality Analyzer, each of which are from OpTest Equipment, Inc. of Hawkesbury, Ontario, Canada, and in accordance with appropriate procedures specified in the manual accompanying the Fiber Quality Analyzer.

The properties of a paper product made with the furnish, e.g., absorption and strength, and/or how much the furnish must be refined to obtain a desired paper product can at least in part be determined by the proportion of SEPF in the furnish. In some methods, mixing can be performed such that the furnish comprises at least 2% SEPF by dry weight, such as, for example approximately 4%, 6%, 8%, 10%, 12%, 14%, 16%, 18%, 20%, 22%, or 24% SEPF. In some methods, mixing can be performed such that the furnish comprises at least 25% SEPF.

Some embodiments of the present methods comprise a step of refining the furnish. The furnish can be refined with any suitable refiner such as, for example, a mechanical refiner configured to beat the furnish. A refiner can comprise, for example, any of the refiners set forth above. In some embodiments, mixing can be performed before the mixture is refined. In other embodiments, the SEPF and the fibers of the first stream can be mixed in the refiner; for example, mixing and refining can be performed simultaneously. Nevertheless, the furnish may not be refined if the fibers of the first stream are refined prior to mixing.

Refining can cause increased hydrogen bonding and a decrease in pores and cavities between fibers in the furnish; as a result, the freeness of the furnish can decrease. As described in further detail below, the furnish or the pulp fibers of the first stream can be refined, e.g., by beating, such that the furnish reaches an appropriate freeness to form a paper product having, for example, desired strength and absorption characteristics. In some methods, refining can be performed such that the furnish has a freeness of 650 milliliters Canadian Standard Freeness (ml CSF) or less, such as, for example, a freeness less than or substantially equal to, or between any two of: 650, 625, 600, 575, 550, 525, or 500 ml CSF. In some instances, refining can be performed such that the furnish has a freeness of 500 ml CSF or less, such as, for example, a freeness less than or substantially equal to, or between any two of: 350, 375, 400, 425, or 450 ml CSF. Freeness can be measured using any suitable procedure, such as, for example, according to TAPPI 227 om-99 (1999 TAPPI), as described in *Freeness of pulp* (*Canadian standard method*), available at https://research.cnr.ncsu.edu/wpsanalytical/documents/T227.PDF, which is hereby incorporated by reference.

A furnish having SEPF can have a lower freeness compared to a furnish without SEPF. Likewise, increasing the proportion of SEPF in a furnish can decrease the freeness of the furnish. By way of illustration, in some methods, an unrefined furnish can have a freeness between approximately 450 and 550 ml CSF; in some of such methods, the furnish can comprise at least 25% SEPF. In other methods, an unrefined furnish can have a freeness between approximately 550 and 650 ml CSF before the refining; in some of such methods, the furnish can comprise at least 10% SEPF. By contrast, a furnish comprising only conventional fibers can have a freeness greater than 650 ml CSF. Accordingly, a furnish comprising SEPF can have the same freeness as a conventional furnish even if the conventional furnish is refined using more refining energy.

Some embodiments of the present methods comprise a step of forming a paper product, such as a tissue or fluff, from the furnish. Forming can be performed using any suitable papermaking machine or system such as, for example, a Fourdrinier machine or a system comprising one or more headboxes, wire screens, rollers, vacuum boxes, dandy rollers, dryers, calenders, reels, and/or the like. The composition of the furnish and the amount the furnish has been refined can at least in part affect the characteristics of the paper product. Refining the furnish can cause fibrillation and shortening of pulp fibers. While increased fibrillation can increase the bonding properties of the paper product, fiber shortening can weaken some mechanical strength of the paper. Accordingly, while in some instances more refinement correlates with a stronger paper product, excessive refinement can decrease paper strength. Moreover, more refinement can reduce a paper product's ability to absorb liquid, at least in part because refining causes fibers to establish stronger bonds, thereby resulting in a paper product having a denser microstructure. In some methods, therefore, the amount of refining, and thus the freeness the furnish reaches from that refining, is an important parameter for forming a paper product that has desired properties; the appropriate amount of refining can depend on, for example, the desired strength and absorption properties of a paper product and the proportion of SEPF in the furnish.

Embodiments of the present tissues can comprise at least 2% SEPF by weight, for example, equal to any one of or between any two of: 2%, 5%, 10%, 15%, 20%, and/or 25% SEPF; in some embodiments, a tissue can comprise at least 25% SEPF by weight. Some tissues can have a grammage between 20 and 60 grams per square meter (g/m$^2$), such as, for example, 30, 35, 40, 45, or 50 g/m$^2$.

As set forth above, the proportion of SEPF in the furnish from which a tissue is formed and the amount the furnish is refined can at least in part affect the absorption capabilities of the tissue. At a given amount of furnish refinement, a tissue having SEPF can have similar absorbency as a conventional tissue; however, as noted above, a furnish comprising SEPF can require less refining than a conventional furnish to, for example, achieve a desired freeness and/or achieve the fibrillation required to produce a tissue having a desired strength. Because furnish refinement can reduce a tissue's ability to absorb liquid, holding freeness constant, a furnish comprising SEPF can produce tissue that can absorb more liquid than can a tissue made from a conventional furnish. At a given freeness, some of the present tissues can, for example, absorb at least 30%, and in some instances at least 50%, more liquid than can conventional tissues. In some embodiments, a tissue comprising SEPF can absorb more liquid than can a conventional tissue having substantially the same tear/tensile index or both.

In some embodiments, a tissue can have improved absorbency while also having similar strength, or increased strength, compared to a conventional tissue. For example, at a given amount of furnish refinement, a tissue having SEPF can be stronger than a tissue that does not incorporate SEPF. To illustrate, some of the present tissues can have a tensile index at least 25% greater, and in some instances at least 50% greater, than the tensile index of a tissue that, while otherwise similar, does not comprise SEPF Likewise, some of the present tissues can have a tear index at least 30% greater, and in some instances at least 60% greater, than a similar tissue comprising only conventional fibers. Thus, in some embodiments, less refinement of the furnish or the fibers of the first stream is required to produce a tissue having the same strength as a tissue formed from conventional furnish; at least in part because less refining is required, such a tissue would be able to absorb more liquid than the conventional tissue.

The improved absorbency of the present tissues can be illustrated with reference to their respective Water Absorption Ratio ($W_{ratio}$) and Absorption Index ($A_{index}$). $W_{ratio}$ of a tissue can be calculated according to the formula:

$$W_{ratio} = \frac{W_{wet}}{W_{dry}}$$

where $W_{wet}$ refers to the weight of a sample of tissue after the sample is submerged in water for approximately 2 seconds and suspended in air for approximately 5 seconds. $W_{dry}$ refers to the weight of the sample before submersion. $A_{index}$ can be used to compare the absorbency of a tissue having SEPF ("SEPF tissue") with that of a conventional, reference tissue that does not have SEPF. The absorption index of any given SEPF tissue can be calculated using any reference tissue that has substantially the same tear index as the SEPF tissue, and substantially the same ratio of conventional hardwood fibers to conventional softwood fibers as the SEPF tissue. As used herein, $A_{index}$ is calculated according to the formula:

$$A_{index} = \left(\frac{W_{ratio,SEPF}}{W_{ratio,ref}} - 1\right) \times 100\%$$

where $W_{ratio,SEPF}$ refers to the water absorption ratio of the SEPF tissue and $W_{ratio,ref}$ refers to the water absorption ratio of a reference tissue. Some of the present tissues can have an absorption index of at least 10%, such as, for example, one that is greater than or substantially equal to any one of, or between any two of: 10%, 15%, 20%, 25%, 30%, 35%, 40%, 45%, or 50%.

EXAMPLES

The present invention will be described in greater detail by way of specific examples. The following examples are offered for illustrative purposes only and are not intended to limit the present invention in any manner. Those of skill in the art will readily recognize a variety of non-critical parameters that can be changed or modified to yield essentially the same results.

Example 1

Handsheets were produced using dried market pulp samples having different percentages of SEPF. Each of the pulp samples comprised softwood kraft pulp and either (1) 0%, (2) 10%, or (3) 25% SEPF by weight. Furnishes were produced from the pulp samples and refined with a Valley beater. Handsheets were produced from the refined furnishes to make a set of handsheets having a grammage of 30 g/m$^2$ and a set of handsheets having a grammage of 60 g/m$^2$. TABLE 1 and TABLE 2 set forth the first set and second set of refining conditions used for Valley beating, respectively. As used herein, an "X % SEPF" furnish or handsheet refers to a furnish or handsheet made from a dried market pulp sample comprising X % SEPF by weight; for example, a 25% SEPF handsheet refers to a handsheet made using a dried market pulp sample comprising 25% SEPF by weight.

Furnish refined by the Valley beater was formed by disintegrating sample pulp sheets to 1.2% consistency, and was beat in accordance with TAPPI 200 sp-01, as described in *Laboratory beating of pulp* (*Valley beater method*), available at https://research.cnr.ncsu.edu/wpsanalytical/documents/T200.PDF, which is hereby incorporated by reference. A TMI Valley beater 208V PM-01 was used. After refining, the furnish was diluted to 0.3% consistency for handsheet formation.

Handsheets having a 60 g/m$^2$ grammage were formed according to TAPPI T205 sp-02, as described in *Forming handsheets for physical tests of pulp*, available at http://www.tappi.org/content/sarg/t205.pdf, which is hereby incorporated by reference. A modified method was used to make 30 g/m$^2$ handsheets; in the modified method, while otherwise similar to TAPPI T205 sp-02, an extra screen was placed over the standard screen former. The 30 g/m$^2$ handsheets were dried on the extra screen, and a ring held the edges of each of the handsheets to minimize shrinkage. In the modified method, each of the rings holding the edges of the handsheets were stacked, with a square plate placed between each ring.

TABLE 1

Refining Conditions for Making 30 g/m$^2$ and 60 g/m$^2$ Valley Beater Handsheets

| Refining Time (minutes) | % SEPF |
|---|---|
| 0* | 0 |
| | 10 |
| | 25 |
| 5 | 0 |
| | 10 |
| | 25 |
| 10 | 0 |
| | 10 |
| | 25 |
| 15 | 0 |
| | 10 |
| | 25 |
| 20 | 0 |
| | 10 |
| | 25 |
| 25 | 0 |
| | 10 |
| | 25 |

*Only produced for 30 g/m$^2$ handsheets

TABLE 2

Refining Conditions for Making 30 g/m$^2$ Valley Beater Handsheets

| Refining Time (minutes) | % SEPF |
|---|---|
| 0 | 0 |
| | 10 |
| | 25 |
| 20 | 0 |
| | 10 |
| | 25 |
| 40 | 0 |
| | 10 |
| | 25 |
| 60 | 0 |
| | 10 |
| | 25 |

After beating, the freeness of each of the furnishes was measured according to TAPPI 227 om-99. TABLE 3 sets forth the freeness of 0% SEPF furnishes and 25% SEPF furnishes beat in accordance with the second refining conditions.

TABLE 3

Effect of Valley Beating on Freeness of 0% SEPF and 25% SEPF Furnishes

| Beating Time (min) | Freeness - 0% SEPF (ml CSF) | Freeness - 25% SEPF (ml CSF) |
|---|---|---|
| 0 | 670 | 500 |
| 20 | 525 | 270 |

TABLE 3-continued

Effect of Valley Beating on Freeness of 0% SEPF and 25% SEPF Furnishes

| Beating Time (min) | Freeness - 0% SEPF (ml CSF) | Freeness - 25% SEPF (ml CSF) |
|---|---|---|
| 40 | 270 | 93 |
| 60 | 60 | 20 |

The freeness of the 25% SEPF furnish was significantly lower than that of the furnish comprising no SEPF. After at least 20 minutes of beating, the 0% SEPF furnish reached the initial freeness—500 ml CSF—of the 25% SEPF furnish.

The water absorption ratio of each of the 0% and 25% SEPF handsheets was calculated by submerging a sample of the handsheet in water for 2 seconds, allowing free water to drip off for 5 seconds, and comparing the weight of the wetted sample with the weight of the sample prior to submerging. FIG. 1 illustrates the relationship between water absorption ratio and freeness for the handsheets. Each of the 60 g/m$^2$ handsheet samples had a lower water absorption ratio than the 30 g/m$^2$ handsheet samples, in part because the 60 g/m$^2$ samples were denser and because the forming process caused the wire side of the 60 g/m$^2$ handsheets to have a more compact structure. Because the 0% SEPF handsheets required more refining to reach the lower freeness of the 25% handsheets, at a given freeness, the 25% SEPF handsheets exhibited superior water absorption capabilities over the 0% handsheets. The results indicate that pulp having SEPF can be used to make tissues with better absorbency compared with tissues made from pulps with no SEPF, when refined to a similar freeness.

Figure 2A:
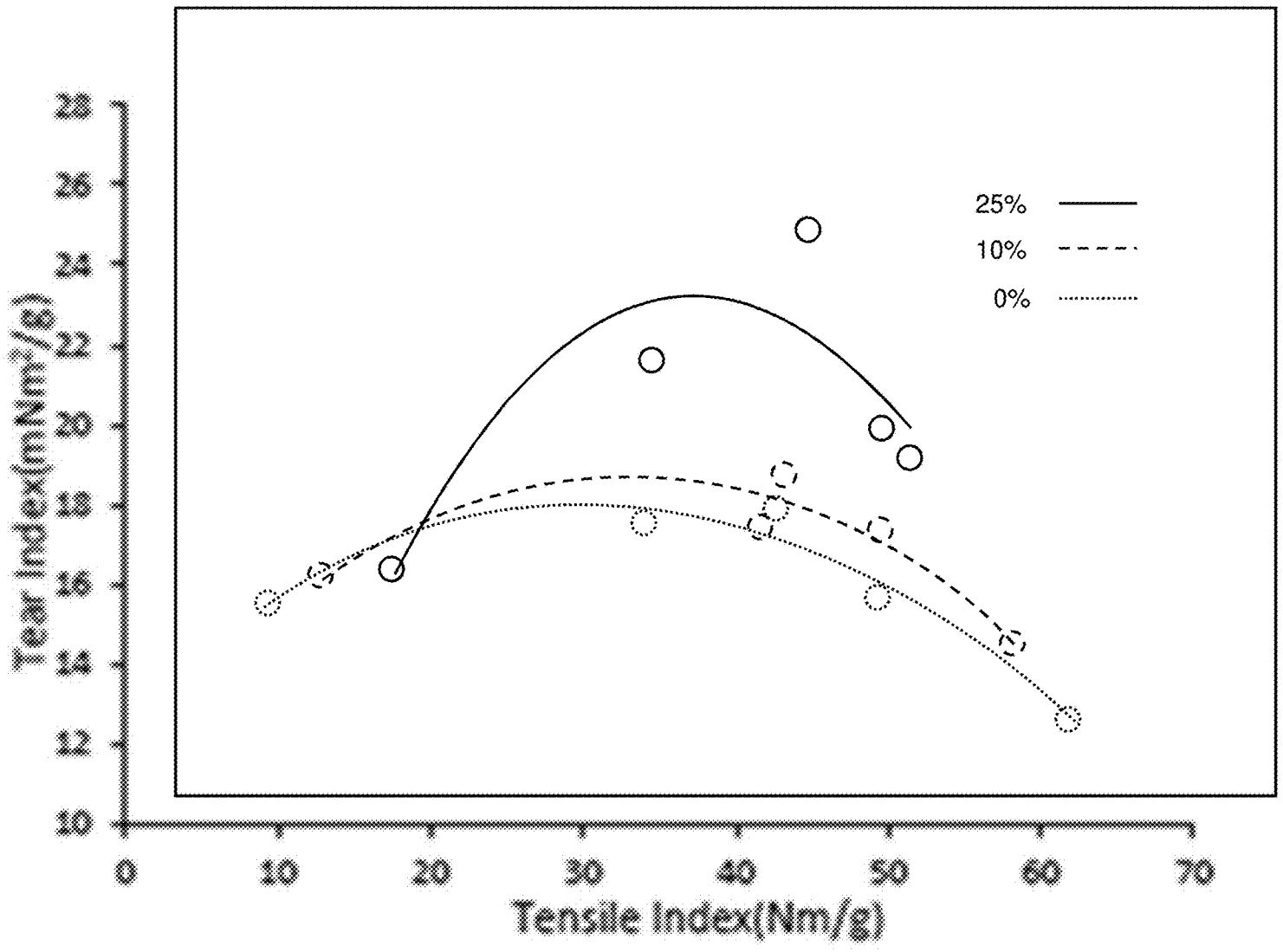
FIGS. 2A and 2B are graphs illustrating the relationship between tensile index and tear index when pulp is refined in a valley beater for some of the present paper products having a grammage of 30 g/m$^2$ and 60 g/m$^2$, respectively.
Figure 2B:
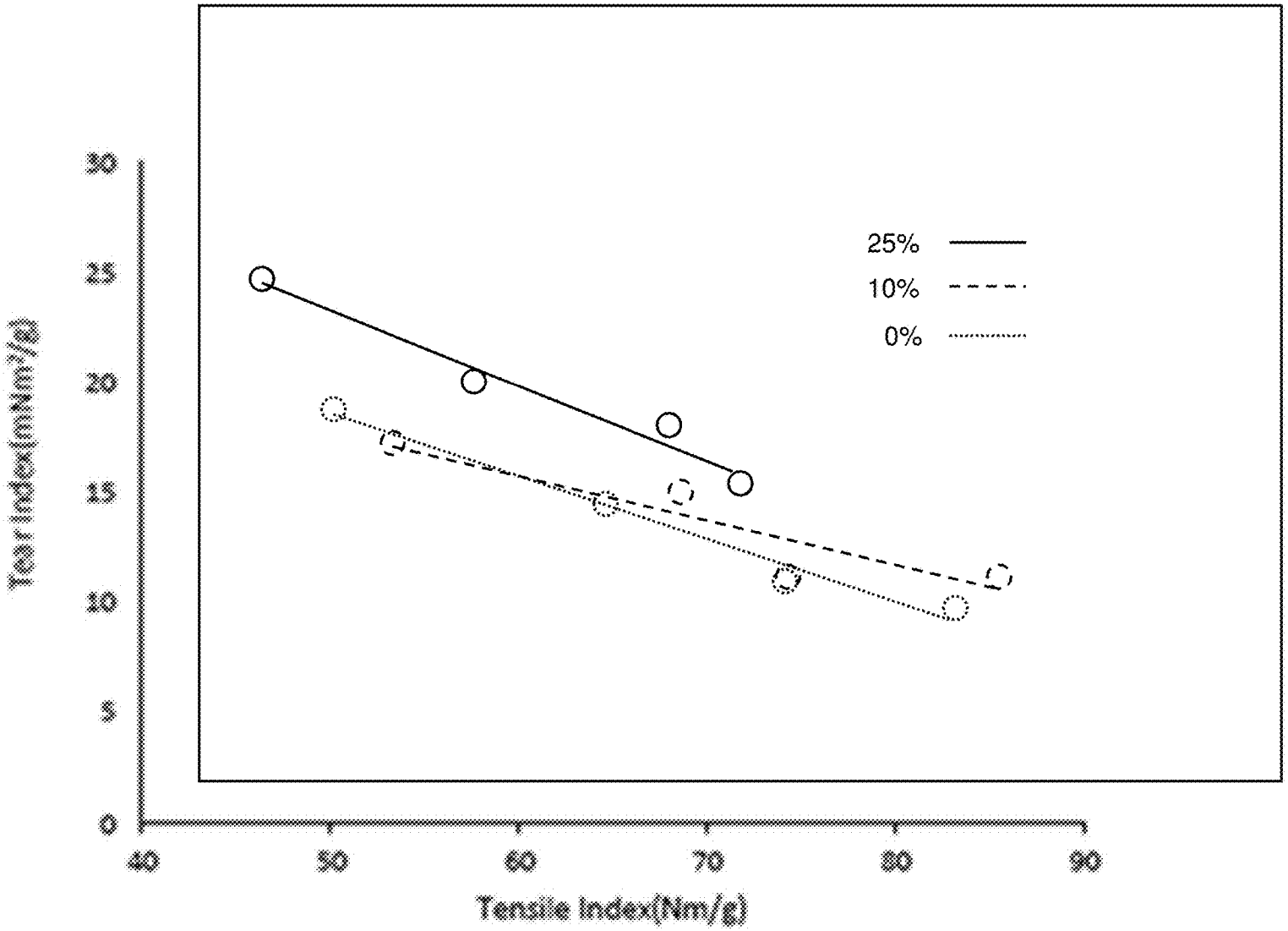

The tear index and tensile index of each of the handsheets were measured according to TAPPI 414 om-98 and TAPPI 494 om-01, respectively. TAPPI t414 om-98 is described in Internal tearing resistance of paper (Elmendorf-type method), available at http://grayhall.co.uk/BeloitResearch/tappi/t414.pdf, and TAPPI 494 om-01 is described in *Tensile properties of paper and paperboard* (*using constant rate of elongation apparatus*), available at http://www.tappi.org/content/SARG/T494.pdf, both of which are hereby incorporated by reference. FIGS. 2A and 2B show the relationship between tensile index and tear index for 0%, 10%, and 25% SEPF handsheets; FIG. 2A shows the relationship for the 30 g/m$^2$ handsheets formed from furnish beaten under the first refining conditions, while FIG. 2B shows the relationship for 60 g/m$^2$ handsheets. Among each of the 30 g/m$^2$ handsheets and 60 g/m$^2$ handsheets, the 25% SEPF handsheet had the highest tear index.

Figure 3A:
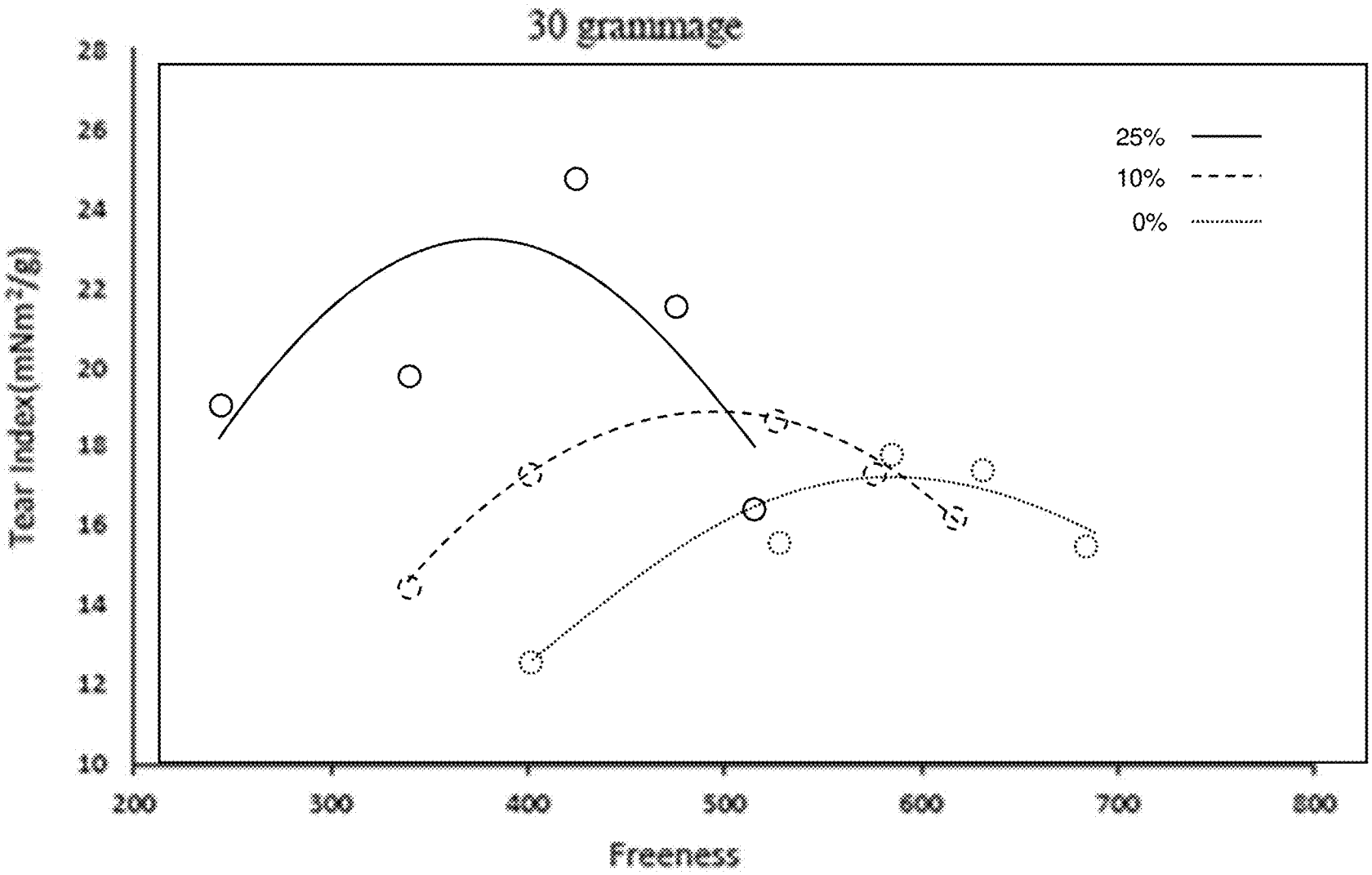
FIGS. 3A and 3B are graphs illustrating the relationship between freeness and tear index and tensile index, respectively, of some of the present paper products with a grammage of 30 g/m$^2$.
Figure 3B:
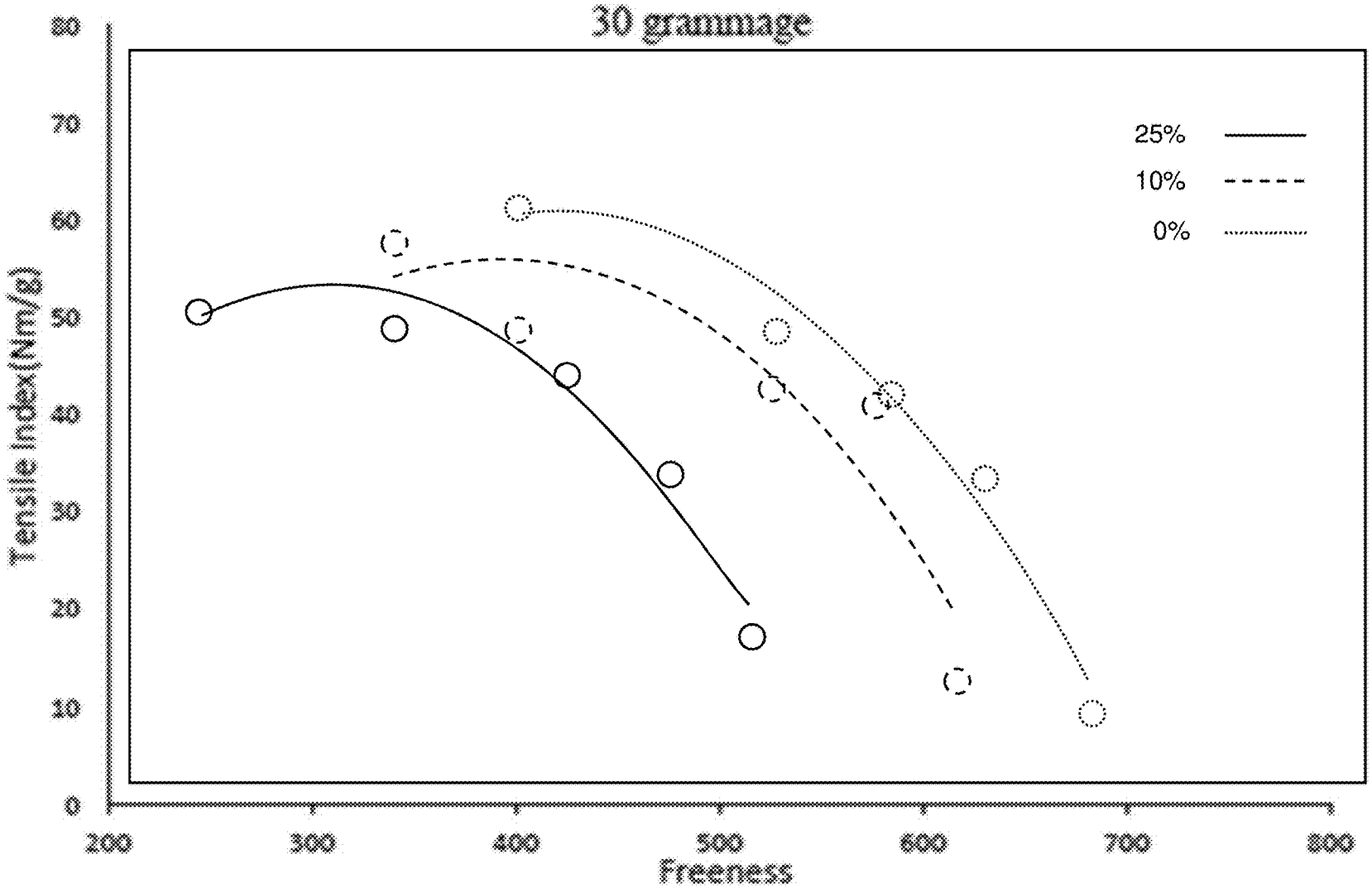

FIGS. 3A and 3B are graphs illustrating tear index and tensile index, respectively, of 0%, 10%, and 25% SEPF handsheets having a grammage of 30 g/m$^2$, versus freeness of the furnish used to form the handsheets. The relationships between freeness and tear index and freeness and tensile index were not strictly monotone. Although decreasing furnish freeness initially resulted in handsheets having increased tear index and tensile index, tear index and tensile index eventually decreased as freeness decreased. Likewise, as can be seen by comparing FIGS. 2A, 3A, and 3B, holding the proportion of SEPF constant, the critical freeness at which tear index began to decrease was greater than that at which tensile index began to decrease. As such, after a critical freeness, reducing freeness resulted in a tradeoff between the tensile strength and the tear strength of the handsheet.

Furthermore, as is apparent from FIGS. 1 and 3A, pulp with SEPF could be used to form a handsheet that was both (1) more absorbent and (2) more tear-resistant than handsheets with no SEPF.

Images of handsheets samples were taken with a Field Emission Scanning Electron Microscope (FESEM). The samples were bombarded with nanometric gold particles to make a 20-nm thick coating to make the surface conductive and avoid charging effects. FIGS. 4A-4F show 600× magnification of 30 g/m$^2$ handsheet samples; TABLE 4 sets forth the figures that correspond to each of the handsheets and the conditions used to form those handsheets.

TABLE 4

FESEM Images of Valley Beater Handsheet Samples with Different Proportions of SEPF and Different Beating Times

Figure 4A:
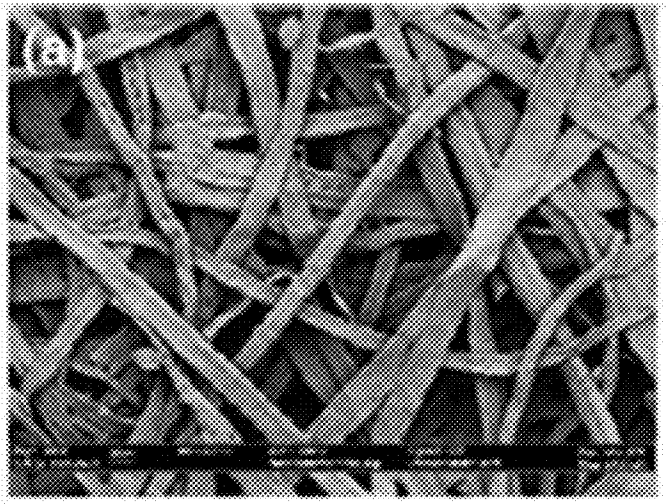
FIGS. 4A-4F are 600× magnification images of some of the present paper products captured using a Field Emission Scanning Electron Microscope.
Figure 4B:
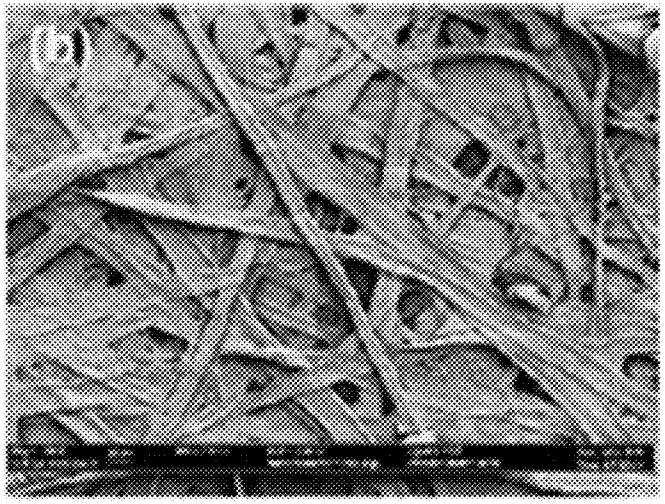
Figure 4C:
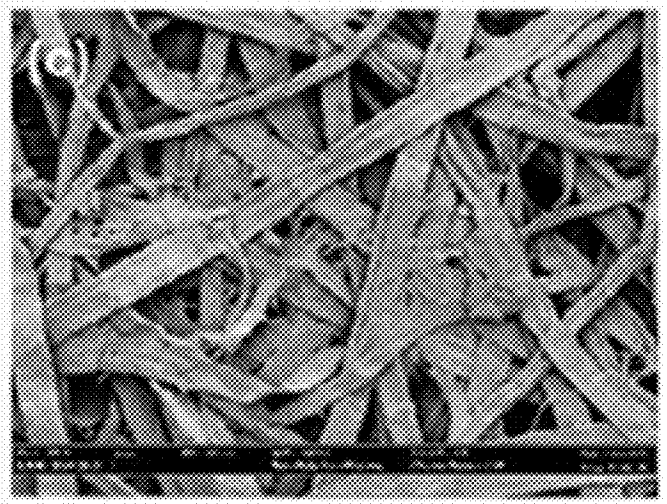
Figure 4D:
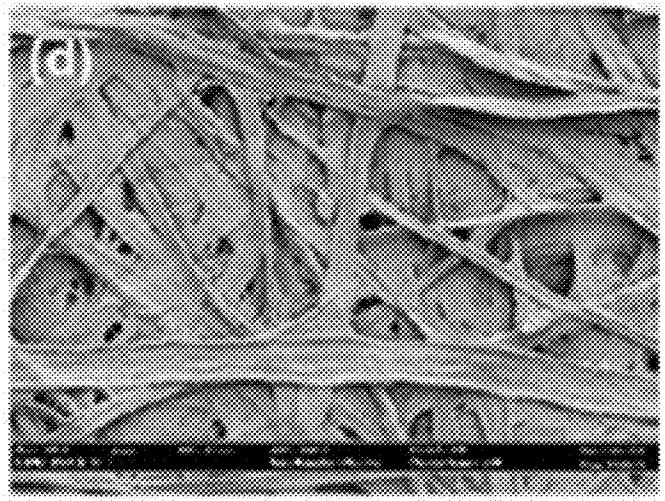
Figure 4F:
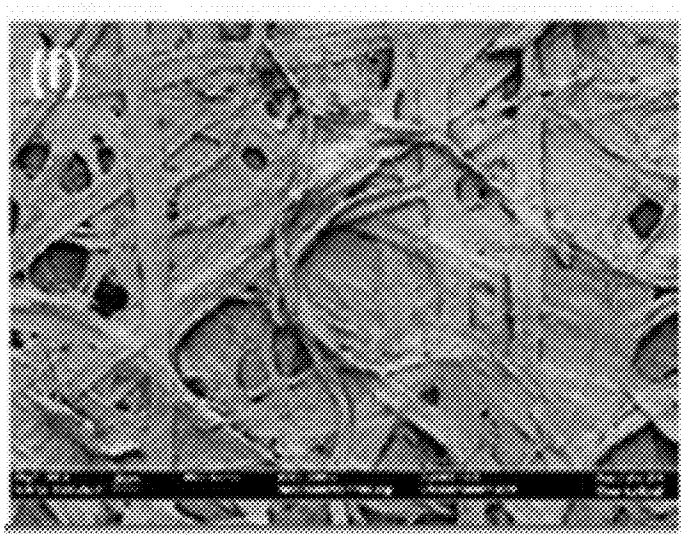
Figure 4E:
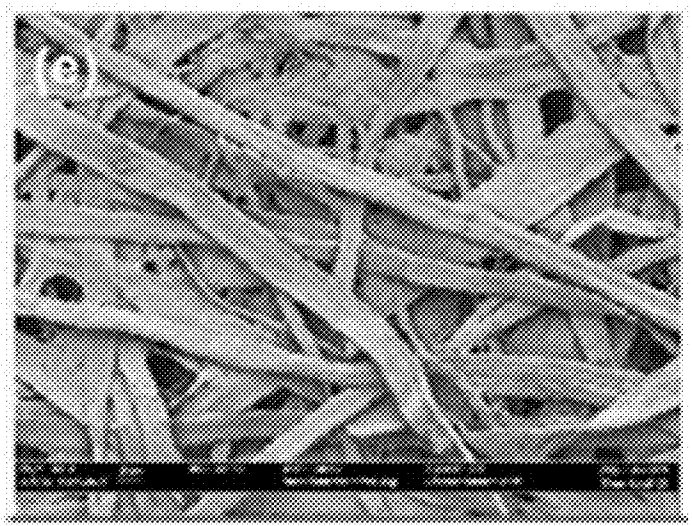

| Beating Time (min) | 0% SEPF | 10% SEPF | 25% SEPF |
|---|---|---|---|
| 0 | FIG. 4A | FIG. 4C | FIG. 4E |
| 20 | FIG. 4B | FIG. 4D | FIG. 4F |

As shown, the samples having 0% SEPF and no beating had the most void spaces. Increasing the proportion of SEPF filled void spaces, with samples having 25% SEPF having the least amount of void spaces, holding beating constant. Beating caused a reduction in the number of cavities and holes in the samples, in part because beating promoted interaction, inter-fibrillated bonding, fiber fines, and fragments in the samples.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A method of manufacturing tissue, the method comprising:

mixing at least a first pulp and a second pulp to generate a furnish, wherein:

the first pulp comprises surface enhanced pulp fibers having a length weighted average fiber length of at least 0.3 millimeters (mm) and an average hydrodynamic specific surface area of at least 10 square meters per gram (m$^2$/g);

the second pulp comprises softwood fibers; and mixing is performed such that the furnish comprises from 10% to 25% surface enhanced pulp fibers by dry weight of fiber in the furnish; and beating, with a refiner, the furnish such that the furnish has a freeness less than or equal to 650 milliliters Canadian Standard Freeness (ml CSF).

2. The method of claim 1, wherein beating is performed such that the furnish has a freeness of 600 ml CSF or less.

3. The method of claim 2, wherein beating is performed such that the furnish has a freeness between 550 ml CSF and 600 ml CSF.

4. The method of claim 1, wherein mixing is performed such that the furnish comprises between 5% and 25% surface enhanced pulp fibers by dry weight of fiber in the furnish.

5. The method of claim 1, comprising forming one or more sheets of tissue using the furnish such that the sheet(s) have a grammage between 20 and 45 grams per square meter (g/m$^2$).

6. The method of claim 1, wherein the softwood fibers of the second pulp comprise Northern bleached softwood kraft fibers.

7. The method of claim 1, wherein beating is performed such that a decrease in the freeness of the furnish is less than or equal to 300 ml CSF.

8. The method of claim 7, wherein beating is performed such that a decrease in the freeness of the furnish is less than or equal to 150 ml CSF.

* * * * *